US006086281A

United States Patent [19]

Covey

[11] Patent Number: 6,086,281

[45] **Date of Patent: *Jul. 11, 2000**

[54] PAGE FINDER APPARATUS AND METHOD

[75] Inventor: Michael Sean M. Covey, Orem, Utah

[73] Assignee: Franklin Covey Co., Salt Lake City, Utah

[ * ] Notice: This patent is subject to a terminal disclaimer.

[21] Appl. No.: 09/044,193

[22] Filed: Mar. 17, 1998

Related U.S. Application Data

[63] Continuation of application No. 08/593,044, Jan. 29, 1996, Pat. No. 5,727,894.

[51] Int. Cl.[7] ..... B42F 13/00

[52] U.S. Cl. ..... 402/79; 281/38

[58] Field of Search ..... 402/79; 281/2, 281/5, 38; 283/56

[56] References Cited

U.S. PATENT DOCUMENTS

| | | | |
|---|---|---|---|
| 4,930,928 | 6/1990 | Ristuccia, Sr. | 402/79 |
| 5,125,561 | 6/1992 | Idstein . | |
| 5,186,565 | 2/1993 | Jack . | |
| 5,316,404 | 5/1994 | Hensel . | |
| 5,333,908 | 8/1994 | Dorney et al. | 402/79 X |
| 5,433,546 | 7/1995 | Kershaw | 402/79 |
| 5,447,336 | 9/1995 | Deighton . | |
| 5,501,540 | 3/1996 | Ho . | |
| 5,727,894 | 3/1998 | Covey | 402/79 |

*Primary Examiner*—Willmon Fridie, Jr.
*Attorney, Agent, or Firm*—Trask, Britt & Rossa

[57] ABSTRACT

The present invention is directed to a page finder for a time management notebook such as a datebook, organizer or planner. The page finder comprises a body with a transparent cover partially affixed to it to form a pocket. An insert card having various role, goal and other personal information is inserted into the pocket. The page finder includes notches along the left side for removably attaching to the binder rings of the time management notebook. Accordingly, insert cards may be removably placed in the pocket, and the page finder may be selectively moved within the notebook to provide a user with ready access to the insert information adjacent to a current time page as the user plans records and reviews periodic activities.

20 Claims, 4 Drawing Sheets

PAGE FINDER APPARATUS AND METHOD

This application is a continuation of Ser. No. 08/593,044, filed Jan. 29, 1996, now U.S. Pat. No. 5,727,849.

BACKGROUND OF THE INVENTION

The present invention relates to page finders for use in datebooks, organizers and planners. More particularly, the present invention relates to a system and method for storing frequently accessed information in a pocket of a page finder which can he removably positioned in a time management notebook.

Page finders are available in a wide variety of forms and sizes for use in time management notebooks, such as datebooks, organizers and planners. A page finder generally marks the current day or week to provide ready access to that portion of the datebook, organizer or planner.

Many time management notebooks include sections for goal setting and record keeping. However, those sections are usually separate from the calendar portion in which activities of the current day or week are recorded. Thus, specific information from the goal section of a datebook, organizer or planner is neither highly visible nor immediately accessible as one records daily and weekly activities. In order to access such goal information, one must open the time management notebook to the desired section and look through each page in order to find the desired information regarding goals. Some datebooks, organizers and planners do not even include sections for setting goals and recording their accomplishment.

One prior art page finder is the Time Resources Goal Keeper™ made by Time Resources in Sydney, N.Y. The apparatus is a full-size notebook page which has an erasable surface for writing and changing the desired information. That page finder device is large and bulky, covering an entire page of dated material. Continued use over a period of time causes the erasable surface to become dirty and unkempt.

What is needed is a page finder system for storing personal information such as roles and goals which provides immediate accessibility to desired information, high visibility of that information, ready replacement of information and retention of its aesthetic qualities during use.

SUMMARY OF THE INVENTION

The present invention comprises a page finder apparatus which addresses the foregoing needs. The page finder provides immediate access to desired personal information while recording daily and weekly activities. The page finder device of the present invention includes one or more transparent pockets for high visibility and easy replacement of an insert with the information. In addition, the page finder of the present invention can be reused frequently with little or no effect on its aesthetic qualities.

A preferred embodiment of the invention includes a body having a plurality of notches attaching the page finder to a binder. The body has at least one pocket for the insertion of a card with personal information thereon. Preferably, the pocket and body are transparent for visibility of the insert.

Another preferred embodiment includes a body with notches for attachment to a binder, having two separate pockets for holding opposite ends of a personal information card. Yet another embodiment includes a body with a hinged flap having a pocket thereon for containing an information insert. A preferred method of the present invention comprises recording personal information such as roles and goals on an information card, inserting the card into a pocket of a page finder device having means for attachment to a time management notebook, attaching the page finder device between pages of the notebook for recording periodic activities and periodically moving the page finder within the notebook to maintain it adjacent to the page for recording current calendar activity. Further advantages of the present invention will become apparent from a consideration of the drawings and the ensuing description.

DRAWING FIGURES

DETAILED DESCRIPTION OF THE PREFERRED EMBODIMENTS

Figure 3:
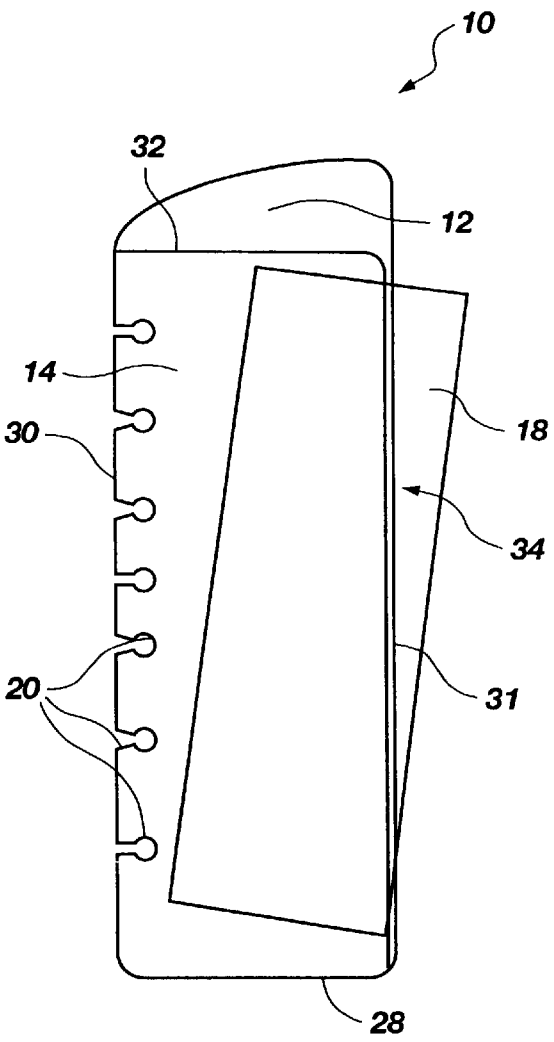
FIG. 3 is a frontal plan view of the embodiment shown in FIG. 1, with an insert placed partially in the pocket.

The present invention is directed to a page finder which stores and displays information in a time management notebook in a manner to be immediately accessible and highly visible when making current time entries. The page finder of the present invention is a simple, flat body having means for readily attaching to and detaching from a time management notebook with at least one pocket for holding an insert having said information. This page finder is especially useful for displaying information which can be frequently accessed and changed. For example, one use of the page finder of the present invention is to display information such as personal roles and goals and the short term steps required to meet those goals.

In this description, three preferred embodiments of the page finder of the present invention are shown—a single pocket embodiment, a two pocket embodiment and a sheet protector embodiment. In these embodiments a flat body is connected to one or more cover members to form one or more pockets for holding an insert card. The body and covers are preferably made from a transparent material so that the front and back of the insert are visible without removing the insert from the pocket. Attachment means, such as notches, are located along the side of the page finder to attach it to a binder. The page finder size, number of pockets, and attachment means and the spacing between the attachment means all vary in order to fit different types and sizes of binders.

Referring to FIGS. 1–4, a page finder 10 comprises a body 12 and a cover 14. Body 12 and cover 14 are preferably made of PETG but can be manufactured from a variety of materials, including plastics and vinyls. The body material is preferably rigid enough to open a book such as a datebook, organizer or planner to the page marked by the page finder, yet flexible enough to resist breaking. The cover material is preferably flexible to enable bending and to also resist breaking.

Cover 14 includes a transparent portion 16, preferably covering the entire face of cover 14. Page finder 10 preferably further comprises at least one insert card 18 which is inserted into a pocket formed between body 12 and cover 14 and can be seen through transparent portion 16. A plurality of attachment notches 20 is formed along the edge of body 12 to attach page finder 10 to a binder.

Figure 2:
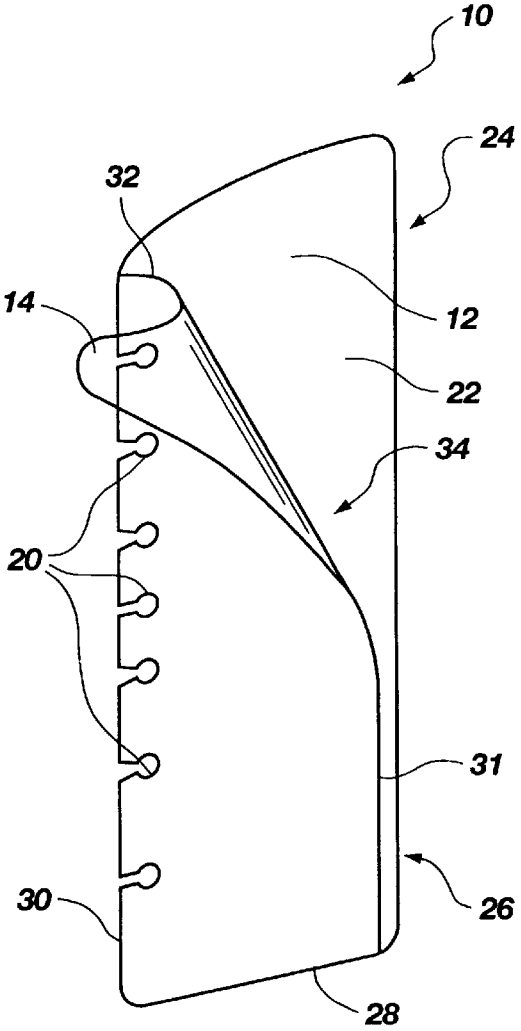
FIG. 2 is a frontal perspective view of the embodiment shown in FIG. 1, with the pocket in a partially open position.
Figure 1:
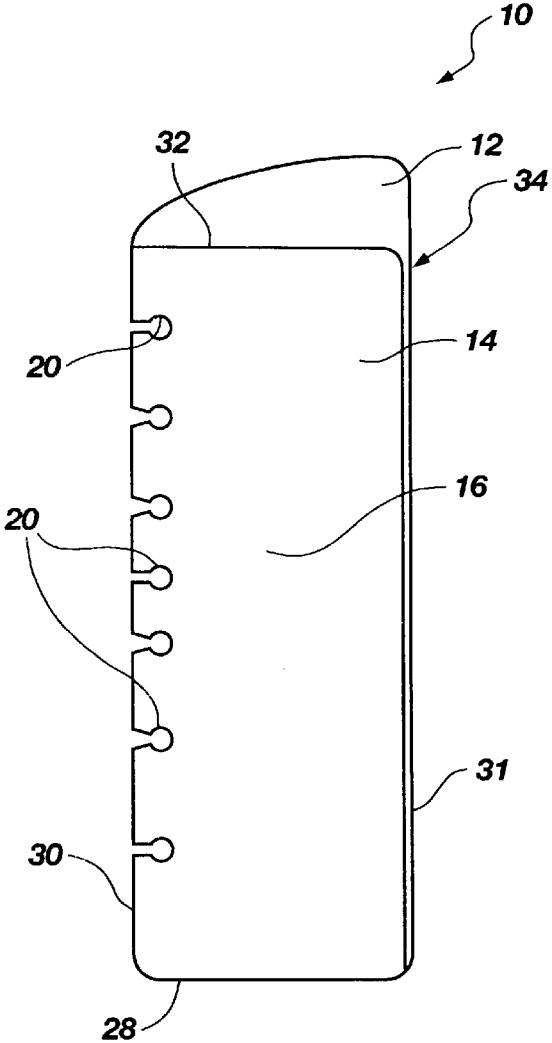
FIG. 1 is a frontal plan view of a preferred single pocket embodiment of the present invention.

Body 12 has a front side 22, a top portion 24 and a bottom portion 26. Preferably, cover 14 has a bottom edge 28, side edges 30 and 31 and a top edge 32. Bottom edge 28 of cover 14 is fixedly attached to front side 22 of body 12 at bottom portion 26. The left side edge 30 is also fixedly attached to body 12. The unattached edges, top edge 32 and the right side edge 31, form a pocket 34 which can be accessed by bending back cover 14 as shown in FIG. 2. Thus, in this embodiment, cover 14 partially opens, providing for easy placement of insert card 18 into pocket 34 between body 12 and cover 14. Insert card 18 is held in place by the fixed attachments at bottom edge 28 and side edge 30 of cover 14.

Figure 10:
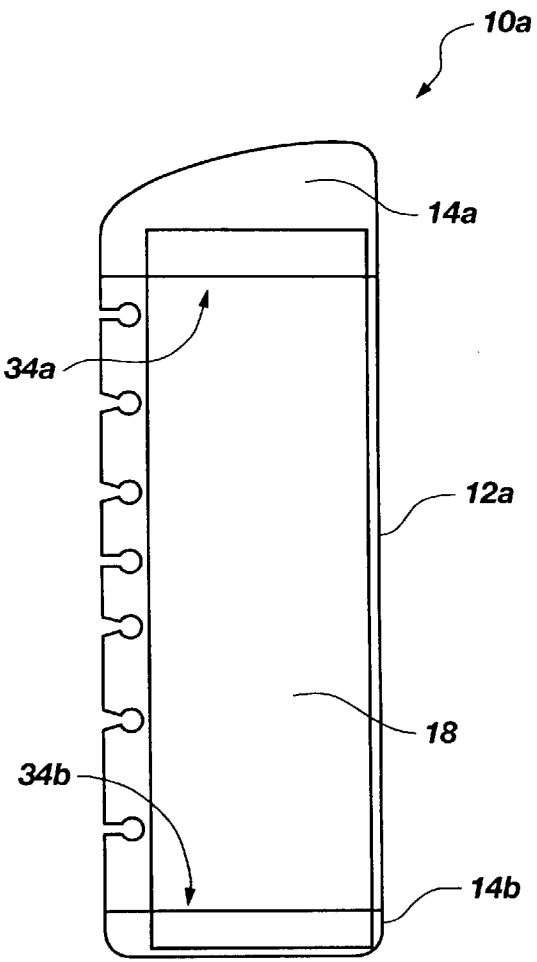
FIG. 10 is a frontal plan view of the two pocket embodiment of FIG. 8 with an insert placed completely in the pockets.
Figure 9:
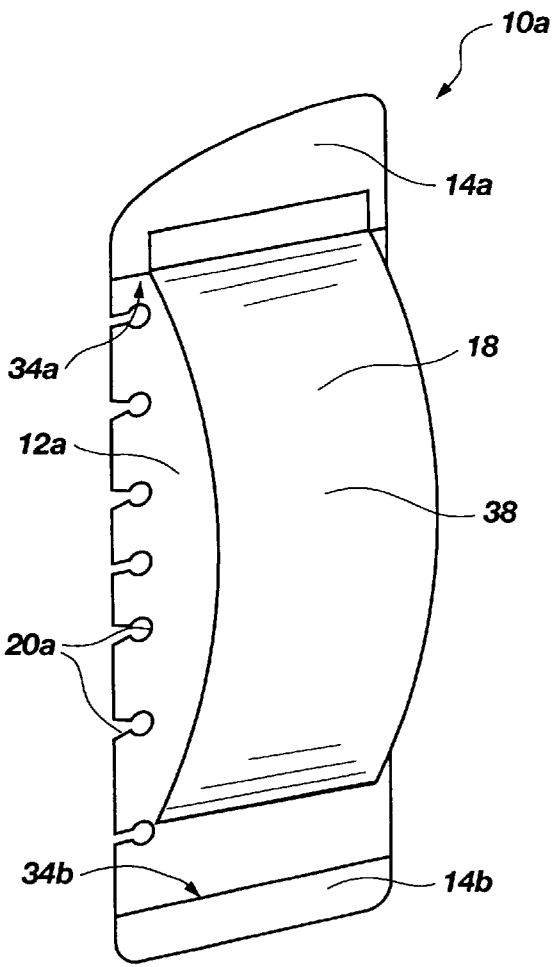
FIG. 9 is a frontal perspective view of the two pocket embodiment of the present invention of FIG. 8 with an insert placed partially in the pockets.
Figure 8:
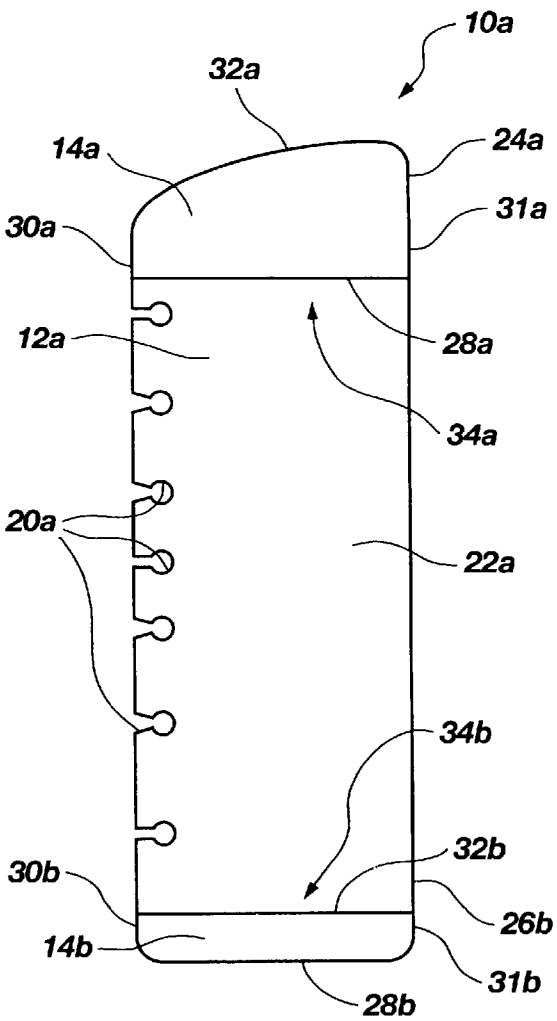
FIG. 8 is a frontal plan view of a preferred two pocket embodiment of the present invention.

FIGS. 8, 9 and 10 show a preferred two pocket embodiment 10*a* of the page finder of the present invention. That embodiment comprises a top cover 14*a* and a bottom cover 14*b*. Top cover 14*a* has a bottom edge 28*a*, two side edges 30*a* and 31*a* and a top edge 32*a*.

Top cover 14*a* is attached to front side 22*a* of body 12*a* at top portion 24*a*. Top edge 32*a* of top cover 14*a* fixedly attaches at the uppermost part of top portion 24*a*. Side edges 30*a* and 31*a* of top cover 14*a* also fixedly attach to body 12*a*. In this embodiment of page finder 10*a*, bottom edge 28*a* of top cover 14*a* forms a top pocket 34*a* to receive the top part of insert 18.

Bottom cover 14*b* attaches to front side 22*a* of body 12*a* at bottom portion 26*b*. Bottom edge 28*b* of bottom cover 14*b* fixedly attaches at the bottom-most part of bottom portion 26*b*. Side edges 30*b* and 31*b* of bottom cover 14*b* also fixedly attach to body 12*a*. Top edge 32*b* of bottom cover 14*b* forms a bottom pocket 34*b* to receive the bottom part of insert 18.

A top part of insert card 18 is inserted in top pocket 34*a* and the bottom part of insert card 18 is inserted in bottom pocket 34*b*, as shown in FIGS. 9 and 10. Thus, insert card 18 is held in place on page finder 10*a* and is uncovered to receive entries and changes in written information.

Figure 11:
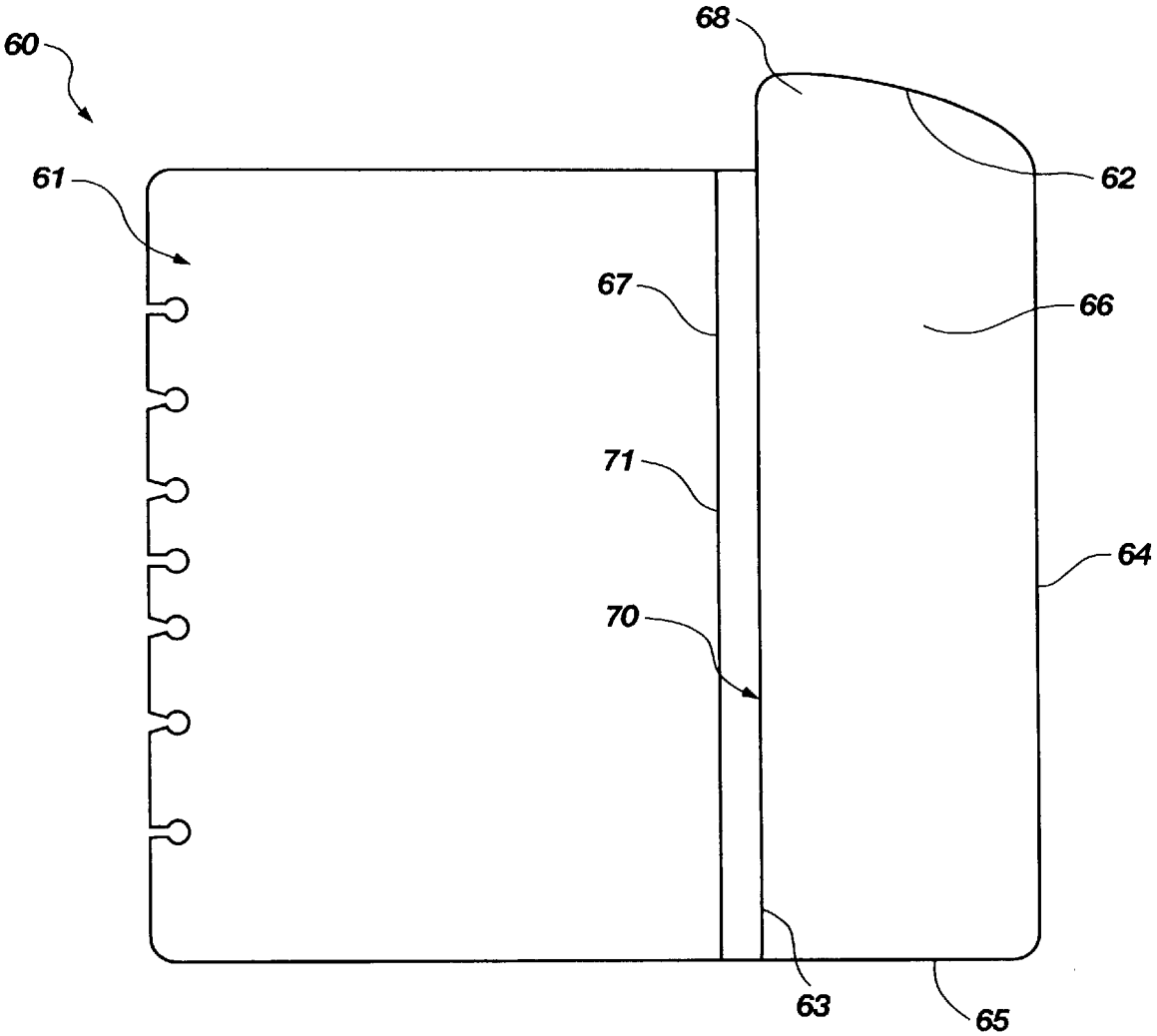
FIG. 11 is a frontal plan view of a preferred sheet protector embodiment of the present invention.

FIG. 11 shows page finder 60, a third embodiment of the present invention. Body 61 is a sheet protector having a flap 68 extending therefrom and hingedly attached to the right side 67 to form a hinge line 71. Thus flap 68 has an open position and a closed position. A cover 66 is attached to flap 68 and has a top edge 62, two side edges 63 and 64 and a bottom edge 65. Top edge 62, bottom edge 65 and one side edge 64 are fixedly attached to flap 68 to form a pocket 70. Side edge 63 is unattached to provide an opening into pocket 70 for insertion of insert card 18. When this embodiment 60 of the page finder is inserted into a time management notebook and flap 68 is in an open position, flap 68 protrudes and is visible when the notebook is closed.

Thus, in this preferred embodiment, insert card 18 remains visible through the transparent portion of cover 65. Embodiment 60 of the page finder provides a user with constant visibility of information, whether the datebook, organizer or planner is in an open position or a closed position. In addition, sheet protector 66 provides for immediate accessibility and full visibility for a current page of information. When flap 68 is in a closed position, it folds onto sheet protector 61 such that it is not visible when the datebook, organizer or planner is closed.

Figure 7:
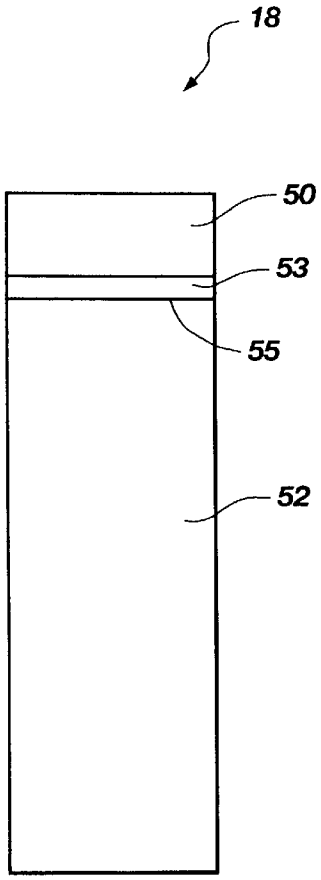
FIG. 7 is a rear plan view of the insert shown in FIG. 5.
Figure 6:
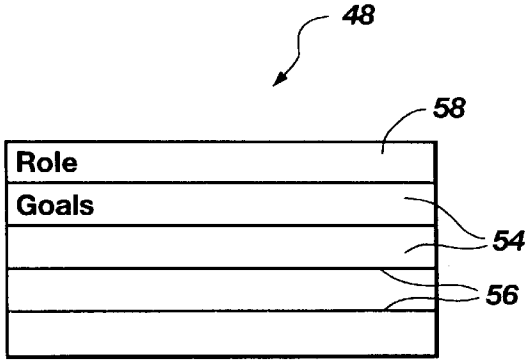
FIG. 6 is a partial close-up frontal plan view of a goal section of the insert shown in FIG. 5.
Figure 5:
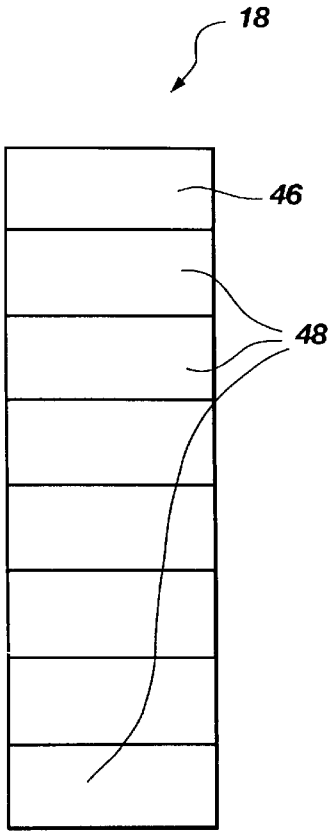
FIG. 5 is a frontal plan view of a preferred embodiment of an insert for use in the present invention.
Figure 4:
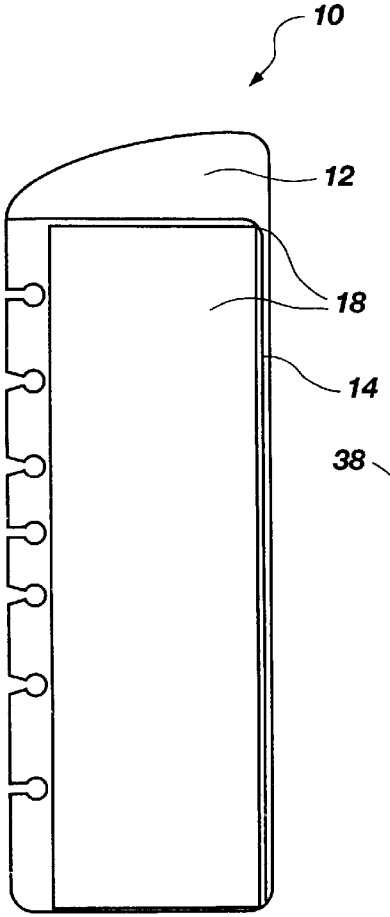
FIG. 4 is a frontal plan view of the single pocket embodiment of FIG. 1, with an insert placed completely in the pocket.

As shown in FIGS. 5, 6 and 7, insert card 18 has a front 38 and a back 40. Insert card 18 is preferably made of a thin, disposable and inexpensive material such as paper or a thin cardboard which can accommodate printing, pencil and ink.

Front 38 comprises a heading portion 46 and a plurality of goal sections 48. Back 40 comprises a quote section 50 and a notes section 52. Preferably, each goal section 48 is further divided into spaces 54 formed by horizontal lines 56. The uppermost space of each goal section is preferably a goal category space 58.

The first goal section 48 preferably contains printed goal statements. For example, goal category space 58 contains a key word or phrase such as "Sharpen the Saw". The remaining spaces 54 in the printed goal section 48 are each labeled with titles such as "Physical", "Social/Emotional", "Mental", "Spiritual", and the like. Preferably, quote section 50 contains a printed quote. Goal category spaces 58 of the remaining goal section 48 are preferably labeled "Role". Preferably, notes section 52 is divided into spaces 53 separated by horizontal lines 55.

As an example of the use and operation of the best mode of the page finder of the present invention, a user writes desired information on insert card 18. In the printed goal section, a user with a long-term physical goal such as preparing for a marathon writes a short-term goal, such as "run fifteen miles each day" in the space labeled "Physical". In the space labeled "Spiritual", a user writes a goal like "meditate for ten minutes". A user then enters personal roles in goal category spaces 58 of the remaining goal sections 48. Following each role, a user enters weekly goals into spaces 54. For example, if one of a user's personal roles deals with being a good father, he would write "Father" as the role in goal category space 58. In the remaining spaces 54 of that goal section 48, the user enters personal goals to help him become a better father, such as "have meaningful conversation with children", "take children to park", "read to children", and the like. The user positions insert card 18 into page finder 10, where the role and goal information is readily accessible and visible as the user plans, records and reviews activities at the current page of a time management notebook.

Figure 12:
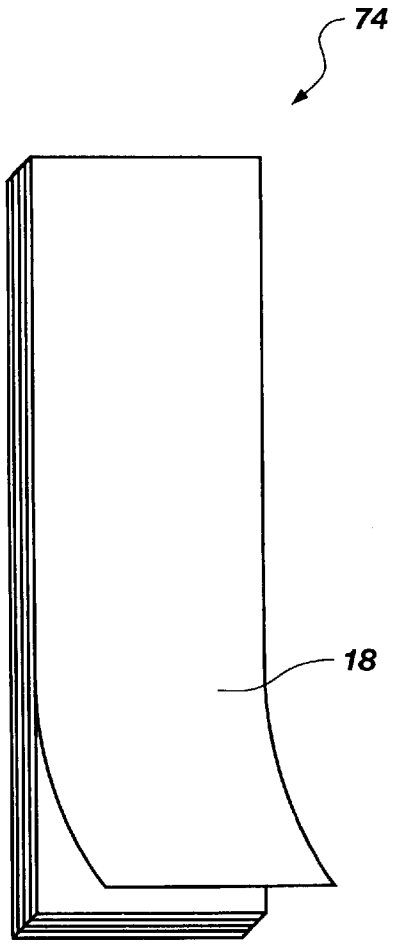
FIG. 12 is a frontal perspective view of a preferred embodiment of a pad of inserts for use in the present invention.

As shown in FIG. 12, insert cards 18 are preferably incorporated into a pad 74, one for each week of the year. Alternatively, a pad may contain twelve inserts, one for each month of the year. Preferably, a user enters information onto insert card 18 at the beginning of a time period, removes insert card 18 from pad 74, and places insert card 18 into the pocket or pockets of a page finder. In the preferred embodiments of the present invention, information on both sides of insert card 18 is visible through the pockets of the page finder.

Although the description above includes many specific details, these should not be construed as limiting the scope of the invention, but as merely providing illustrations of some of the presently preferred embodiments of this invention. Other embodiments of the page finder of the present invention are readily conceivable within the scope of the invention. Likewise, the elements of the page finder of the present invention may be constructed from any material that will fulfill the stated purpose and retain the functionality of each element.

The scope of the invention should be determined by the appended claims and their legal equivalents, as follows.

What is claimed is:

1. A page finder for use in a time management notebook, comprising:

a substantially flat insert upon information regarding time management may be recorded; and a substantial flat member disposable within the time management notebook and including:

attachment means for securing said substantially flat member to the time management notebook, said attachment means disposed adjacent an edge of said substantially flat member; and a pocket that is at least partially transparent and which is capable of receiving said substantially flat insert.

2. The page finder of claim 1 and further comprising a flat member affixed along at least one edge thereof to the body and having at least one edge thereof not affixed to the body to form said pocket.

3. The page finder of claim 1 wherein the attaching means includes means for removably attaching the body to rings of the notebook without opening the rings.

4. The page finder of claim 1 and further comprising an insert containing time management information adapted to be positioned in said pocket.

5. A page finder for use in a time management notebook, comprising:

a substantially flat body member;

attachment means adjacent an edge of the substantially flat body member for removably attaching the substantially flat body member to the time management notebook, and an at least partially transparent flat cover member attached along an edge thereof to said substantially flat body member and including a second edge unattached to said substantially flat body member to form a pocket into which an insert upon which time management information is recordable is removably insertable.

6. The page finder of claim 5 wherein the flat cover member is flexible to partially bend away from the body member to enable placing the insert in the pocket.

7. The page finder of claim 5 wherein the flat cover member entirely covers a face of the insert in the pocket.

8. The page finder of claim 5 wherein the attachment means comprises a plurality of notches along an edge of the flat body member for removably attaching to rings of the notebook.

9. The page finder of claim 5 wherein the flat cover member comprises an upper flap partially attached to an upper portion of the flat body member to form an open upper pocket, and a lower flap partially attached to a lower portion of the flat body member to form an open lower pocket.

10. The page finder of claim 9 and further comprising a flat strip having indicia thereon adapted to be attached to the flat body member by inserting one end of the strip in the open upper pocket and another end of the strip in the open lower pocket.

11. The page finder of claim 5 and further comprising a first portion of the flat body member having the attachment means along one edge thereof, a second portion of the flat body member having the cover member partially attached thereto to form an open pocket, and connecting means joining the first portion to the second portion.

12. The page finder of claim 11 wherein the connecting means is a hinge element extending along the length of the flat body member enabling the second portion to swivel relative to the first portion.

13. The page finder of claim 11 and further comprising an information strip adapted for removable insertion in the open pocket.

14. A method of tracking personal information during periodic planning and recording of activities in a time management notebook, comprising:

entering the personal information on a substantially flat article;

placing the article upon a substantially flat member adapted to fit between pages of the time management notebook;

removably attaching the substantially flat member within the time management notebook adjacent a current page for recording activities of a current time period; and periodically replacing the substantially flat member within the time management notebook.

15. The method of claim 14, further comprising attaching the article to a flat body configured to fit between the pages of a time management notebook and removably attaching the flat body to the notebook.

16. The method of claim 14, further comprising placing the article in an open pocket in a flat body configured to fit between the pages of a time management notebook, removably attaching the flat body to the time management notebook and periodically moving the flat body to maintain the body adjacent to the current page of the notebook for planning and recording current activities.

17. A page finder for use in a notebook, comprising:

a substantially flat body member;

at least one attachment notch adjacent an edge of the substantially flat body member for securing the substantially flat body member to the notebook; and an at least partially transparent flat cover member attached along an edge thereof to said substantially flat body member and including a second edge unattached to said substantially flat body member to form a pocket into which an insert is removably insertable.

18. The page finder of claim 17, wherein said insert comprises a front having printing thereon and a blank portion for entering personal information.

19. The page finder of claim 18, wherein said blank portion has at least one goal section and a plurality of horizontal lines for entering goal information.

20. The page finder of claim 19, further comprising a role heading section at the tope of each goal section.

* * * * *

UNITED STATES PATENT AND TRADEMARK OFFICE

CERTIFICATE OF CORRECTION

PATENT NO. : 6,086,281
DATED : July 11, 2000
INVENTOR(S) : Covey

It is certified that error appears in the above-identified patent and that said Letters Patent is hereby corrected as shown below:

Column 1,
Line 4, change "5,727,849." to -- 5,727,894. --;

Column 2,
Line 60, after "embodiments" insert -- , --;

Column 3,
Line 60, after "Thus" insert -- , --;

Column 4,
Line 5, change "cover 65." to -- cover 66. --;
Line 9, after "addition," insert -- the -- and delete "66"; and
Line 12, after "protector" insert -- body --.

Column 5, claim 1,
Line 14, after "upon" insert -- which --;
Line 16, change "substantial" to -- substantially --;

Column 5, claim 2,
Line 25, change "the body" to -- a body --;

Column 5, claim 3,
Line 28, change "attaching" to -- attachment --;
Line 29, change "the body" to -- said substantially flat member --;

Column 5, claim 5,
Line 40, after "notebook" change "," to -- ; --;

UNITED STATES PATENT AND TRADEMARK OFFICE

CERTIFICATE OF CORRECTION

PATENT NO. : 6,086,281
DATED : July 11, 2000
INVENTOR(S) : Covey

It is certified that error appears in the above-identified patent and that said Letters Patent is hereby corrected as shown below:

Column 6, claim 20,
Line 60, after "of" insert -- said --; and
Line 61, change "tope" to -- top -- and change "each" to -- at least one --.

Signed and Sealed this

Fifth Day of March, 2002

*Attest:*

*Attesting Officer*

JAMES E. ROGAN
*Director of the United States Patent and Trademark Office*